US005466988A

United States Patent [19]

Horiuchi et al.

[11] Patent Number: 5,466,988

[45] Date of Patent: Nov. 14, 1995

[54] HIGH PRESSURE DISCHARGE LAMP HAVING IMPROVED CONVECTION REGULATING MEANS

[75] Inventors: Makoto Horiuchi, Osaka; Kazutaka Koyama, Nishinomiya; Takayuki Kamitani, Osaka; Masataka Ozawa, Takarazuka, all of Japan

[73] Assignee: Matsushita Electric Industrial Co., Ltd., Kadoma, Japan

[21] Appl. No.: 59,218

[22] Filed: May 7, 1993

[30] Foreign Application Priority Data

May 11, 1992 [JP] Japan ..... 4-117175
Nov. 16, 1992 [JP] Japan ..... 4-304313

[51] Int. Cl.[6] ..... H01J 7/24; H01J 61/52

[52] U.S. Cl. ..... 313/35; 313/570; 313/17; 313/20; 313/33; 313/38; 313/609; 313/612

[58] Field of Search ..... 313/570, 572, 313/17, 20, 25, 33, 35, 38, 609, 612, 634, 160, 161

[56] References Cited

U.S. PATENT DOCUMENTS

| | | | |
|---|---|---|---|
| 2,263,032 | 11/1941 | Farnsworth | 313/160 |
| 2,367,595 | 1/1945 | Marden | 313/612 |
| 3,109,952 | 11/1963 | Beese | 313/207 |
| 3,867,660 | 2/1975 | Fohe | 313/12 |
| 4,794,297 | 12/1988 | Gauge et al. | 313/117 |
| 5,296,779 | 3/1994 | Muzeroll | 313/25 |

FOREIGN PATENT DOCUMENTS

| | | |
|---|---|---|
| 8601283 | 10/1986 | Germany . |
| 60-107251 | 6/1985 | Japan . |
| 61-165944 | 7/1986 | Japan . |

OTHER PUBLICATIONS

"Reducing Additive Segregation in Metal Halide High–Intensity Discharge Lamps", Zollweg, Journal of IES, 1975, pp. 12–19.

*Primary Examiner*—Sandra L. O'Shea
*Assistant Examiner*—Matthew J. Esserman
*Attorney, Agent, or Firm*—Renner, Otto, Boisselle & Sklar

[57] ABSTRACT

A high pressure discharge lamp is disclosed. The high pressure discharge lamp includes: a discharge tube which is filled with gas; a first electrode having a first end, the first electrode being provided in the discharge tube; and a second electrode having a second end which is positioned away from the first end by a certain distance, the second electrode being provided in the discharge tube. In the high pressure discharge lamp, arc discharge is induced by a voltage applied between the first end of the first electrode and the second end of the second electrode. The high pressure discharge lamp further includes a convection regulating member which is electrically insulating and provided in the discharge tube. The convection regulating member suppresses the deformation of the arc discharge caused by the convection of the gas in the discharge tube.

17 Claims, 3 Drawing Sheets

HIGH PRESSURE DISCHARGE LAMP HAVING IMPROVED CONVECTION REGULATING MEANS

BACKGROUND OF THE INVENTION

1. Field of the Invention

The present invention relates to a high pressure discharge lamp such as a high pressure mercury lamp, a high pressure sodium lamp, a metal halide lamp, and a high pressure xenon lamp.

2. Description of the Related Art

A high pressure discharge lamp is widely used as a light source which can supply light with a high luminous intensity. In general, a high pressure discharge lamp includes a light transmissible arc tube which is filled with a rare gas, mercury, metal halide and the like, and a pair of electrodes provided in the arc tube. FIG. 13 shows a cross section of a metal halide lamp which is one type of a conventional high pressure discharge lamp. This metal halide lamp includes a quartz arc tube (discharge tube) 1 which is filled with metal halide, mercury, and rare gas, and a first electrode 3*a* and a second electrode 3*b*. The arc tube 1 is sealed with pinches 2*a* and 2*b* which support the pair of electrodes 3*a* and 3*b*. Arc discharge is induced by voltage applied across the pair of electrodes 3*a* and 3*b*. The light emission of the filling materials due to the arc discharge is utilized for general lighting, lighting for an apparatus such as an overhead projector (OHP), or the like.

Hereinafter, a virtual straight line which connects one end of the first electrode 3*a* to one end of the second electrode 3*b* is sometimes referred to as an "electrode axis". When a lamp is lighting in such a manner that the electrode axis is set substantially horizontal, the lamp is said to be in horizontal lighting. Also, a lamp which is produced for the purpose of such use is referred to as a lamp of horizontal lighting type. On the other hand, when a lamp is lighting in such a manner that the electrode axis is set substantially vertical, the lamp is said to be in vertical lighting. Also, a lamp which is produced for the purpose of such use is referred to as a lamp of vertical lighting type.

The mass and ionization potential of a metal contained in the arc tube 1 varies depending on the kind of the metal. Based on the fact, for example in an Sc-Na type metal halide lamp, at the center of the arc, light is emitted by mercury. In the peripheral portion of the arc, light is emitted by Sc. In the further outer portion (in the outermost portion), light is emitted by Na. As a result, the emission spectrum is not uniform for various portions of the arc.

In addition, as is shown in FIG. 13, when the high pressure discharge lamp is in the horizontal lighting, the arc is curved due to buoyancy caused by the convective phenomenon of the filler gas. When the high pressure discharge lamp is in the vertical lighting, an upper portion of the arc is expanded, and a lower portion thereof is narrowed (pointed), so that the arc has the shape of teardrop. As a result of the curved or teardrop shape, the nonuniformity of emission spectrum for various portions of the arc is further increased.

When the arc of the high pressure discharge lamp is deformed due to the convection phenomenon of the filler gas as described above, it is difficult to design an optical system which uses the high pressure discharge lamp as a light source. Especially when the high pressure discharge lamp is used as a light source for a projection-type display, the deformation of the arc is magnified on the screen, whereby the quality of the projected image is degraded.

In addition, as is shown in FIG. 13, when the high pressure discharge lamp is in the horizontal lighting, the arc is curved due to buoyancy. As a result, the temperature of the upper portion of the arc tube 1 rises, so that the upper portion of the arc tube 1 is more thermally expanded, as compared with the lower portion of the arc tube 1. Such thermal expansion of the arc tube 1 causes the lifetime of the high pressure discharge lamp to be shortened.

SUMMARY OF THE INVENTION

The high pressure discharge lamp of this invention includes: a discharge tube which is filled with gas; a first electrode having a first end, the first electrode being provided in the discharge tube; and a second electrode having a second end which is positioned away from the first end by a certain distance, the second electrode being provided in the discharge tube, wherein arc discharge is induced by a voltage applied between the first end of the first electrode and the second end of the second electrode, the high pressure discharge lamp further comprising convection regulating means which is electrically insulating and provided in the discharge tube, the convection regulating means suppressing the deformation of the arc discharge caused by the convection of the gas in the discharge tube.

In one embodiment of the invention, a virtual straight line connecting the first end of the first electrode to the second end of the second electrode is set substantially horizontal, and the convection regulating means is provided on at least one of upper and lower sides of the straight line.

In another embodiment of the invention, the convection regulating means is fixed to the discharge tube by supporting means.

In another embodiment of the invention, the convection regulating means takes a curved shape around the virtual straight line.

In another embodiment of the invention, the convection regulating means takes a plate-like shape.

In another embodiment of the invention, the convection regulating means is a light transmitting sleeve member having a bore around a virtual straight line connecting the first end of the first electrode to the second end of the second electrode, the arc discharge being induced in the bore.

In another embodiment of the invention, the bore of the convection regulating means includes at least one of the first and second ends.

In another embodiment of the invention, the virtual straight line connecting the first end of the first electrode to the second end of the second electrode is set substantially horizontal.

In another embodiment of the invention, the first end of the first electrode is positioned vertically above the second end of the second electrode, and a portion of the second electrode which includes at least the second end is located in the bore.

In another embodiment of the invention, a portion of the first electrode which includes at least the first end is also located in the bore, and a length d3 of the portion of the first electrode is smaller than a length d4 of the portion of the second electrode (d3<d4).

In another embodiment of the invention, the lamp is a direct current type high pressure discharge lamp in which the first electrode functions as an anode, and the second electrode functions as a cathode. In this embodiment, a portion of the second electrode as the cathode which includes at least the second end is located in the bore.

In another embodiment of the invention, a portion of the first electrode which includes at least the first end is also located in the bore. In this embodiment, a length d5 of the portion of the first electrode is smaller than a length d6 of the portion of the second electrode (d5<d6).

In another embodiment of the invention, the convection regulating means is directly supported by an inner wall of the discharge tube. In this embodiment, a gap is provided between the convection regulating means and the inner wall of the discharge tube, in order to suppress the stress caused by a difference between a coefficient of thermal expansion of the convection regulating means and a coefficient of thermal expansion of the inner wall of the discharge tube.

In another embodiment of the invention, the convection regulating means includes two or more flanges made of the same material as that of the convection regulating means, the convection regulating means being supported by the inner wall of the discharge tube via the flanges. In this embodiment, a gap is provided between the flanges and the inner wall of the discharge tube, in order to suppress the stress caused by a difference between a coefficient of thermal expansion of the convection regulating means and a coefficient of thermal expansion of the inner wall of the discharge tube.

In another embodiment of the invention, the convection regulating means includes two or more O-shaped rings having a plurality of radial protrusions, the convection regulating means being supported by an inner wall of the discharge tube via the O-shaped rings. In this embodiment, a gap is provided between the O-shaped rings and the inner wall of the discharge tube, in order to suppress the stress caused by a difference between a coefficient of thermal expansion of the convection regulating means and a coefficient of thermal expansion of the inner wall of the discharge tube.

In another embodiment of the invention, the high pressure discharge lamp further includes a light transmitting and infrared reflecting film provided outside of the discharge tube.

In another embodiment of the invention, the convection regulating means includes an insulating portion with light diffusibility.

In another embodiment of the invention, at least one of end portions of the bore of the sleeve member has a larger diameter than that of a center portion of the bore.

In another embodiment of the invention, the sleeve member is located in the discharge tube with gaps between at least parts of circumferential end portions of the sleeve member and an inner wall of the discharge tube.

In another embodiment of the invention, the sleeve member is located in the discharge tube via supporting means, the supporting means being a light transmitting insulator with elasticity.

In another embodiment of the invention, the discharge tube is made of ceramics.

By providing convection regulating means in an arc tube, the arc is prevented from being deformed due to the convection in the arc tube. Especially, in the case of the horizontal lighting, by providing a member which functions as the convection regulating means at a position vertically above the electrode axis, the convection of the filler gas flowing from the lower portion to the upper portion of the arc tube is changed so that the filler gas flows horizontally in the vicinity of the upper portion of the arc. As a result, the flow rate of the filler gas which flows in a horizontal direction in the vicinity of the upper portion of the arc is increased. Alternatively, by providing a member at a position under the electrode axis, the flow rate of the filler gas which flows into the arc from the lower portion of the arc tube is decreased. As a result, the curving degree of the arc is suppressed, and the temperature of the upper portion of the arc tube lowers. Therefore, in the horizontal lighting, the uniformity of emission spectrum for various portions of the arc and the lamp lifetime can be improved.

In addition, by providing a member so as to cover part of an electrode, the electrode is easily warmed but not easily cooled because of the heat reserving effect of the member. This causes the thermoelectrons to be easily emitted from the electrode at the start and the restart of the discharge, whereby the start ability and the restart ability of the lamp can be improved. The degree of the heat reserving effect by the member is suitably changed by changing the degree to which the electrode is covered with the member.

When the lamp is in the vertical lighting, by providing a cylindrical member around an electrode axis, an ascending flow of the filler gas in the peripheral portion of the arc is parallel to the inner wall of the cylindrical member. As a result, the shape of the arc changes from the teardrop shape to a fusiform. Therefore, the uniformity of emission spectrum for various portions of the arc can be improved.

In addition, if such a cylindrical member covers part of the electrode as described above, the electrode is also easily warmed and not easily cooled. In this case, also, the degree of the heat reserving effect by the member can be suitably changed by the degree to which the electrode is covered with the member. Accordingly, in the vertical lighting in which the temperature of an upper electrode is higher, a length of the part of a lower electrode which is covered with the cylindrical member is made larger than a length of the part of the upper electrode which is covered with the member. By such an arrangement, the start ability and the restart ability of the lamp can be improved without causing an extraordinary rise in the temperature of the upper electrode.

In a high pressure lamp in which an electrode temperature at an anode is higher, the same as in the above case, a length of a cathode which is covered with a member is made larger than a length of the anode which is covered with a member. By this arrangement, the start ability and the restart ability of the lamp can be improved without causing a rise in the temperature of the anode.

In addition, when a cylindrical member is formed into such a shape that a diameter at each end of the cylindrical member is made larger than a diameter in the vicinity of the center thereof, a distance from an end portion of an electrode to the inner wall in the vicinity of the end of the cylindrical member is increased. As a result, grains of electrode materials scattered from the electrode are easily diffused, and hence the blackening can be prevented from being concentrated at the ends of the cylindrical member.

In addition, if a cylindrical member is provided in the arc tube with a slight gap between the cylindrical member and an inner wall of the arc tube, or if a cylindrical member is provided via an elastic and light transmitting support means, the gap or the elastic support means absorbs an extraordinary thermal stress caused by various coefficients of expansion, even when the arc tube and the cylindrical member are made of different materials with different coefficients of expansion from each other. As a result, a danger that the arc tube or the member will be damaged by cracks can be avoided.

In addition, if a member is made of a light transmitting insulator with diffusibility, light beams emitted from various portions of the arc are mixed with each other in the member when the light beams pass through the member, whereby the uniformity of spectrum for various emitting portions can be improved at an emitting face of the member.

These and other advantages of the present invention will become apparent to those skilled in the art upon reading and understanding the following detailed description with reference to the accompanying figures.

DESCRIPTION OF THE PREFERRED EMBODIMENTS

Hereinafter, metal halide lamps will be described as examples of a high pressure discharge lamp of the invention with reference to FIGS. 1A through 12B.

Figure 1A:
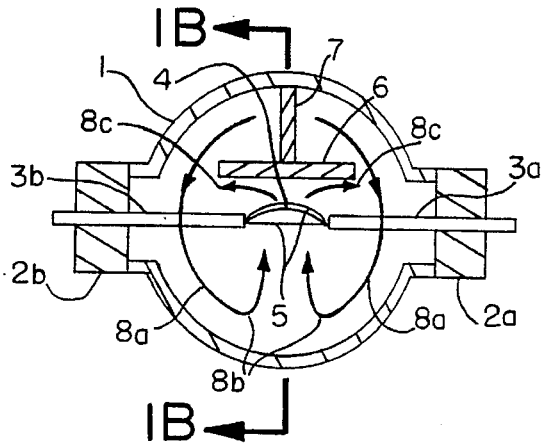
FIG. 1A is a cross-sectional view showing a metal halide lamp in a first example according to the invention.
Figure 1B:
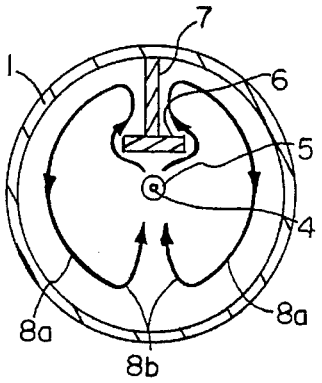
FIG. 1B is a cross sectional view taken along a line 1B—1B in FIG. 1A.

A first example of the invention will be described with reference to FIGS. 1A, 1B, and 2. FIG. 1A is a cross-sectional view showing a metal halide lamp of this example in a horizontal lighting. FIG. 1B is a cross-sectional view taken along a line 1B—1B in FIG. 1A.

The metal halide lamp of this example includes a quartz arc tube (a discharge tube) 1 which is filled with metal halide, mercury, and rare gas, a first electrode **3*a* having a first end, and a second electrode 3*b* having a second end which is set away from the first end by a certain distance (e.g., 20 mm). The first and the second electrodes 3*a* and 3*b* are provided in the arc tube 1. The arc tube 1 is sealed with pinches 2*a* and 2*b* which support the first and second electrodes 3*a* and 3*b*. The outer diameter of the arc tube 1 is 22.2 mm, and the inner diameter thereof is 20 mm. The pressure of argon gas filled in the arc tube 1 is about 20 Torr, and the amount of mercury is about 50 mg. As the metal halide, the arc tube 1** contains scandium iodide ($ScI_3$) of about 2.5 mg, and sodium iodide (NaI) of about 12.5 mg.

The first and second electrodes **3*a* and 3*b* are tungsten electrodes each having a diameter of 1 mm. In this example, parts of the first and second electrodes 3*a* and 3*b* which extend from the pinches 2*a* and 2*b* each have a length of about 10 mm. By applying voltage across the first and the second electrodes 3*a* and 3*b*, an arc discharge is induced between the first end of the first electrode 3*a* and the second end of the second electrode 3*b*. In each figure, an arc core portion 4, and an arc peripheral portion 5** are shown. Such an arc discharge in the lamp consumes a power amount of, for example, 60 Watts (W).

The metal halide lamp of this example further includes convection regulating means which is electrically insulating and provided in the arc tube 1. The convection regulating means regulates the convection so as to suppress the formation of an arc induced by the convection of the filler gas in the arc tube 1. The convection of the filler gas is schematically shown by curves **8*a*, 8*b*, 8*c***.

The high pressure discharge lamp of this example has a member 6 as the convection regulating means. The member 6 is made of insulating alumina ceramics and has a plate-like shape. A supporting bar 7 fixes the member 6 to the inner wall of the arc tube 1. For the material of the member 6, any one of alumina ceramics (including sapphire), magnesia, zirconia, yttria, aluminum nitride, and the like can be used. These materials all have high electrical insulation and high thermal resistance. All the above materials, except for aluminum nitride, have light transmitting property.

According to the high pressure discharge lamp of this example, the filler gas first lowers from an upper portion of the arc tube 1 to a lower portion thereof along a convective direction indicated by the curve **8*a*. Then, the filler gas ascends along a convective direction indicated by the curve 8*b* and flows into an arc region. When the filler gas flows out of the arc region, the filler gas flows horizontally along a convective direction indicated by the curve 8*c*. Therefore, a filler gas pressure in the upper portion of the arc is increased as compared with the case where the member 6 is not provided in the arc tube 1. As a result, the curving degree of the arc is reduced. Thus, according to this example, the arc substantially has an axisymmetric shape. The expansion of the arc is suppressed by the strong convection of the filler gas in the horizontal direction in the arc upper portion. As a result, a difference in spectrum between the emitted light from the arc core portion 4 and the emitted light from the arc peripheral portion 5 is suppressed. Moreover, the reduction in the curving degree of the arc allows a temperature of the upper portion of the arc tube 1 to be lowered, whereby the thermal stress on the upper portion of the arc tube 1** is reduced.

As described above, according to the high pressure discharge lamp of this example, the uniformity of emission spectrum for various portions of the arc can be improved. In other words, as the result of the compression of the arc, no lighting variation is observed along an arc diameter direction. Due to this advantage, an optical system which uses the high pressure discharge lamp as a light source can be easily designed. Moreover, as the result of the reduction in the thermal stress on the upper portion of the arc tube 1, the lifetime of the lamp is remarkably extended.

Figure 2:
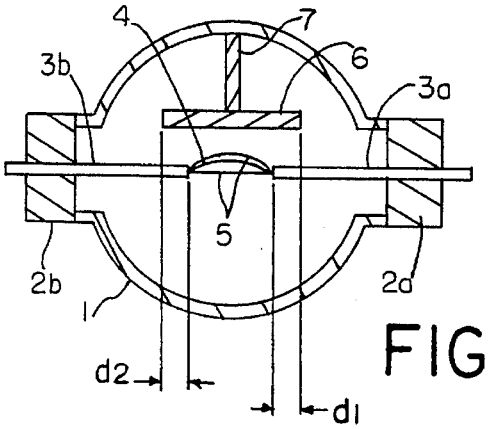
FIG. 2 is a cross-sectional view illustrating a mounting portion of a member in the first example.

FIG. 2 is a cross-sectional view of the arc tube 1 for illustrating the mounting conditions of the member 6 on the arc tube 1 shown in FIGS. 1A and 1B. In FIG. 2, a length d1 indicates a length of a portion of the first electrode 3*a* which is covered with the member 6. A length d2 indicates a length of a portion of the second electrode 3*b* which is covered with the member 6. The construction of the metal halide lamp shown in FIG. 2 is the same as that shown in FIGS. 1A and 1B.

The member 6 covers part of the first electrode 3*a* and part of the second electrode 3*b*. Therefore, due to the heat reserving effect of the member 6, the rise in temperature of the first and second electrodes 3*a* and 3*b* is promoted at the start of the arc discharge. As a result, the arc discharge start and restart abilities can be improved as compared with a conventional lamp without the member 6. It is considered that the degrees to which the member 6 reserves the temperatures of the first and the second electrodes 3*a* and 3*b* are in proportion to the lengths d1 and d2, respectively.

In FIG. 2, both the part of the first electrode 3*a* and the part of the second electrode 3*b* are covered with the member 6. However, it is sufficient that at least one of the parts of the first and the second electrodes 3*a* and 3*b* which are generally paired is covered with the member 6. In the case of an AC-type high pressure discharge lamp, if thermoelectrons are easily emitted from one of the first and the second electrodes 3*a* and 3*b*, the discharge is easily started or restarted. For this reason, if at least one of the first and the second electrodes 3*a* and 3*b* is covered with the member 6, the discharge start and restart abilities can be improved.

Next, with reference to FIGS. 3A and 3B, a high pressure discharge lamp as a second example of the invention will be described.

Figure 3A:
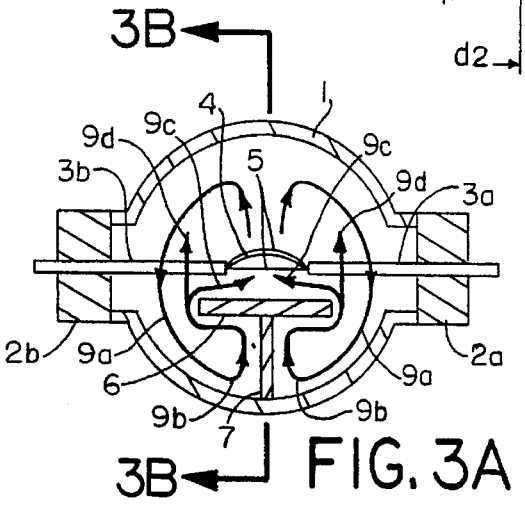
FIG. 3A is a cross-sectional view showing a metal halide lamp in a second example according to the invention.
Figure 3B:
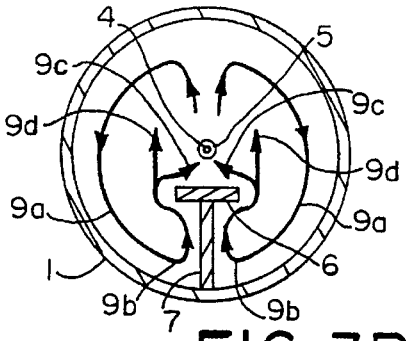
FIG. 3B is a cross-sectional view taken along a line 3B—3B in FIG. 3A.

FIG. 3A is a cross-sectional view showing a metal halide lamp in a horizontal lighting. In the metal halide lamp, a member which covers part of a lower portion of the electrode axis is provided in an arc tube. FIG. 3B is a cross-sectional view taken along a line 3B—3B in FIG. 3A. In FIGS. 3A and 3B, curves 9*a*, 9*b*, 9*c*, and 9*d* indicate convective directions of the filler gas. The construction of this example is the same as in the first example, except for the location of the member.

The operation of the metal halide lamp of this example will be described below.

In a stable lighting, the filler gas in the arc tube 1 lowers to the lower portion of the arc tube 1 along the convective direction indicated by the curve 9*a*, and then flows to the arc along the convective direction indicated by the curve 9*b*. The filler gas is intercepted by the member 6 below the arc, so that some of the filler gas flows toward the arc along the convective direction indicated by the curve 9*c*, and the remaining filler gas ascends to the upper portion of the arc tube 1 instead of flowing to the arc along the convective direction indicated by the curve 9*d*. In other words, the amount of filler gas which flows into the arc region from the lower portion of the arc tube 1 decreases as compared with a conventional lamp without providing the member 6. Accordingly, the buoyancy which acts on the arc is reduced, and the curving degree of the arc is reduced. As a result, the arc becomes vertically symmetric with respect to the electrode axis (precisely, axially symmetric). In addition, the curving degree of the arc is decreased, so that the temperature of the upper portion of the arc tube 1 lowers, and the thermal stress on the upper portion of the arc tube 1 is reduced. As the result of the above advantages, the uniformity of emission spectrum for various portions of the arc can be improved, whereby an optical system including the lamp can be easily designed. Moreover, the lifetime of the lamp is remarkably improved.

As is shown in FIG. 3A, in the case where the member 6 covers the lower portion of the electrodes 3*a* and 3*b*, also, thermoelectrons can easily be emitted from the electrodes 3*a* and 3*b* at the start and the restart of the arc discharge, due to the heat reserving effect of the member described in the first example, whereby the start and the restart abilities of the arc discharge can be improved.

Further, also in this example, the start and restart abilities can be improved due to the heat reserving effect of the member 6 by covering at least one of the parts of the first and the second electrodes 3*a* and 3*b* with the member 6. This fact is apparent from the description in the first example.

In the above first and second examples, the member 6 is formed of insulating and light transmitting alumina ceramics. However, the member 6 may be formed of any light transmitting electric insulator having light diffusibility (for example, polycrystalline alumina ceramics). The term "light diffusibility" used herein indicates a property for propagating incident light in nonuniform directions, whereby a spatial pattern of the incident light becomes uniform as a result of the propagation. If the member 6 is formed of the insulating electrical insulator having such light diffusibility, light beams emitted from various portions of the arc are mixed in the member 6 when they pass through the member 6. As a result, the uniformity of spectrum for various portions can be improved to a higher degree at the emitting face of the member 6. Therefore, an optical system which is used in conjunction with a high pressure discharge lamp of the invention is more easily designed.

In the above first and second examples, the member 6 provided in the arc tube 1 takes a plate-like shape, and it is rectangular in section along the electrode axis direction. However, the shape of the member 6 is not limited to that particular shape. For example, the member 6 may take a plate-like shape that is semicircular in section along the electrode axis direction.

Alternatively, it is appreciated that, in the case where the constructions of the first and second examples are combined so that two structures which cover the upper and the lower portions of the electrode axis are provided in the arc tube 1, the same effects in the first and second examples can be obtained.

Figure 4B:
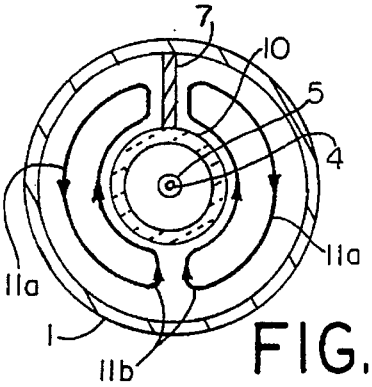
FIG. 4B is a cross-sectional view taken along a line 4B—4B in FIG. 4A.

Next, with reference to FIGS. 4A and 4B, a high pressure discharge lamp as a third example of the invention will be described.

Figure 4A:
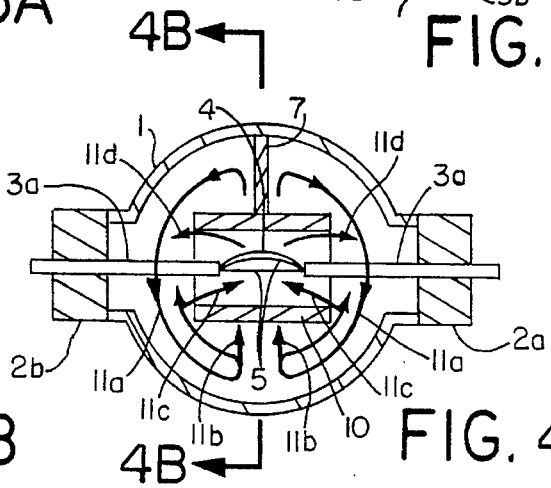
FIG. 4A is a cross-sectional view showing a metal halide lamp in a third example according to the invention.

FIG. 4A is a cross-sectional view showing a metal halide lamp in a horizontal lighting. In the metal halide lamp, a cylindrical member is provided in an arc tube 1. FIG. 4B is a cross-sectional view taken along a line 4B—4B in FIG.

4A. In FIGS. 4A and 4B, curves 11*a*, 11*b*, 11*c*, and 11*d* indicate convective directions of the filler gas.

The lamp of this example includes a cylindrical member (sleeve member) 10 having a bore in which the electrode axis is positioned. The construction is the same as that in the first example except for the member 10. The material of the cylindrical member 10 is insulating and light transmitting alumina ceramics. Regarding the size of the cylindrical member 10 typically used in this example, the outer diameter is 12.2 mm, the inner diameter is 10 mm, and the length measured along the electrode axis is 16 mm.

According to the lamp of this example, in the stable lighting, the filler gas lowers to the lower portion of the arc tube 1 along the convective direction indicated by the curve 11*a* separately goes in two directions. That is, some of the filler gas ascends along an outer wall of the cylindrical member 10 in the convective direction indicated by the curve 11*b*, and the other goes to the inside of the cylindrical member 10 in the convective direction indicated by the curve 11*c*. Accordingly, the amount of the filler gas which flows into the inside of the cylindrical member 10 is suppressed to a value corresponding to the area of each of the openings at the ends of the cylindrical member 10. As a result, the amount of gas which flows into the arc is reduced as compared with the conventional lamp without the cylindrical member 10. Moreover, the filler gas which flows out of the arc is changed in its convective direction to be horizontal in the vicinity of the arc upper portion, as indicated by the curve 11*d*. Accordingly, the flowing rate of the filler gas in the horizontal direction in the vicinity of the arc upper portion is increased. Therefore, the buoyancy which acts on the arc is reduced, and the curving degree of the arc is reduced as compared with that in the conventional lamp without the cylindrical member 10. In addition, the strong horizontal convection in the arc upper portion suppresses the arc expansion. As a result, a difference in spectrum between the arc core portion 4 and the arc peripheral portion 5 is also suppressed. Furthermore, the reduced curving degree of the arc causes the temperature of the upper portion of the arc tube 1 to lower, whereby the heating degree of the upper portion of the arc tube 1 is reduced.

Figure 14:
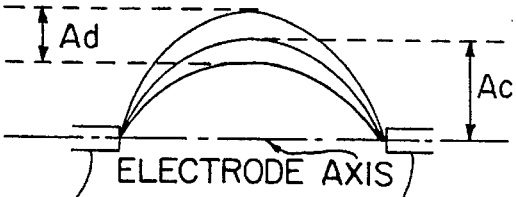
FIG. 14 is a view schematically illustrating a relationship between an arc, and an arc diameter and an arc curving degree.

FIG. 14 is a view schematically illustrating a relationship between an arc, and an arc diameter Ad and a curving degree Ac of the arc. Herein, the arc diameter Ad is represented by a distance between an end which is remotest from the electrode axis and an end which is closest to the center of the electrode axis. The arc curving degree Ac is represented by a distance between a portion of the arc where the luminance is highest (i.e., a center portion of the light emitting region of the arc) and the electrode axis. A lamp with the cylindrical member 10 and a lamp without the cylindrical member 10 are measured as to the arc diameter Ad and the arc curving degree Ac. As the result of the measurement, for the lamp with the cylindrical member 10, the arc diameter Ad is about 5.5 mm, and the arc curving degree Ac is almost 0 mm. On the other hand, for the lamp without cylindrical member 10, the arc diameter Ad is about 8 mm, and the arc curving degree Ac is about 2.5 mm. Thus, as the result of the compression of the arc, the conventional problem of the luminous variation along the arc radial direction can be solved.

As described above, the uniformity of emission spectrum for various portions of the arc can be improved to a degree where it is negligible in designing an optical system which is used in conjunction with a metal halide lamp. Moreover, the lamp lifetime is remarkably extended.

As is shown in FIG. 4A, the cylindrical member 10 covers end portions of the electrodes 3*a* and 3*b*. Accordingly, due to the heat reserving effect of the cylindrical member 10, thermoelectrons are easily emitted from the electrodes 3*a* and 3*b* at the start and the restart of the discharge, as compared with the conventional lamp without the cylindrical member 10, whereby the start and the restart abilities of discharge can be improved.

As is shown in FIG. 4A, in this example, part of each of the electrodes 3*a* and 3*b* is covered with the cylindrical member 10. However, as described in the first example, it is sufficient that part of at least one of the electrodes 3*a* and 3*b* is covered with the cylindrical member 10 for the purpose of improving the start and the restart abilities of discharge.

Alternatively, one or more small holes having a certain shape may be provided in the lower portion of the cylindrical member 10. In this case, immediately after the lighting, the filler gas easily goes into the arc region through the one or more holes of the cylindrical member 10, so that the effect that the rise of light emission is made faster can be obtained.

Figure 5:
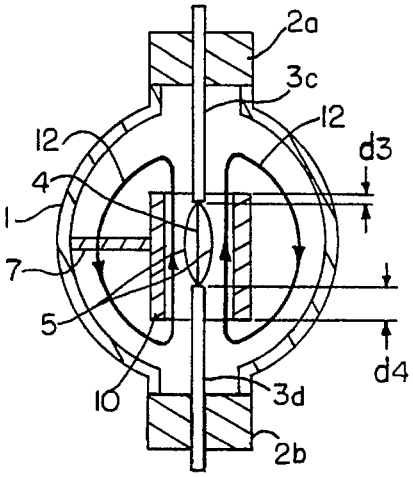
FIG. 5 is a cross-sectional view showing a metal halide lamp in a fourth example according to the invention.

Next, a high pressure discharge lamp as a fourth example of the invention will be described with reference to FIG. 5. FIG. 5 is a cross-sectional view showing a metal halide lamp in a vertical lighting. In the metal halide lamp, a cylindrical member 10 is provided in an arc tube 1. The lamp includes an upper electrode 3*c* and a lower electrode 3*d*. In FIG. 5, a length d3 and a length d4 indicate lengths of parts of the upper and the lower electrodes 3*c* and 3*d* which are covered with the cylindrical member 10, respectively. A curve 12 indicates a convective direction of the filler gas in the vertical lighting. The construction is the same as that in the third example except for the above-mentioned matters.

In the metal halide lamp of vertical lighting type of this example, the convection of the filler gas in the vicinity of the arc peripheral portion 5 is parallel to the inner wall of the cylindrical member 10 along the convective direction indicated by the curve 12. Thus, the entire arc peripheral portion 5 is uniformly influenced by the convection. Therefore, the arc shape changes from a teardrop shape to a fusiform, as compared with the arc shape in the conventional lamp without the cylindrical member 10. The parallel convection of the filler gas in the vicinity of the arc peripheral portion 5 suppresses the arc expansion. As the result of the above, the uniformity of emission spectrum for various portions of the arc can be far improved.

In the vertical lighting, the convection of the filler gas around the arc occurs from the lower electrode 3*d* to the upper electrode 3*c* in the convective direction indicated by the curve 12. The heat of the arc is carried toward the upper electrode 3*c* by the convection, so that the temperature of the upper electrode 3*c* is generally higher than that of the lower electrode 3*d*. This means that the upper electrode 3*c* is more likely to wear. Therefore, in the vertical lighting, the cylindrical member 10 only has to cover at least the lower electrode 3*d* for the purpose of heat reserving, whereby the start and the restart abilities of discharge can be improved without causing a serious wear of the upper electrode 3*c*. In other words, the cylindrical member 10 may be provided so as not to cover the upper electrode 3*c*. The degree of the heat reserving effect by the cylindrical member 10 varies depending on the degree to which the electrodes 3*c* or 3*d* is covered with the cylindrical member 10. As is shown in FIG. 5, if the cylindrical member 10 is provided in such a manner that the lengths d3 and d4 satisfy a condition of d3<d4, the start and the restart abilities of discharge can be improved without causing extra wear of the upper electrode 3*c*. It is appreciated that even if the lengths d3 and d4 have a relationship of d3≧d4, the effect of uniform light emission can be obtained.

Figure 6:
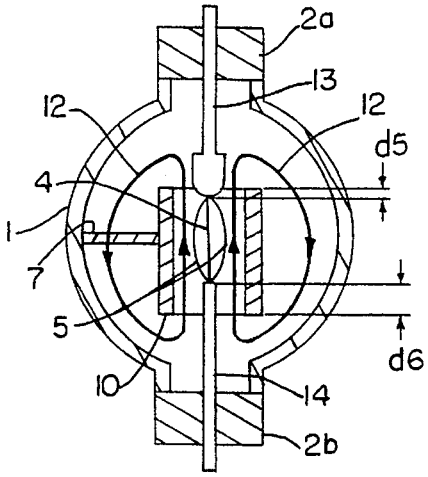
FIG. 6 is a cross-sectional view showing a metal halide lamp in a fifth example according to the invention.

Next, a high pressure discharge lamp as a fifth example of the invention will be described with reference to FIG. 6. FIG. 6 is a cross-sectional view showing a metal halide lamp of D.C. lighting type. In the metal halide lamp, a cylindrical member is provided in an arc tube 1. The lamp includes an anode 13 and a cathode 14. In FIG. 6, a length d5 and a length d6 indicate lengths of parts of the anode and the cathode 13 and 14 which are covered with a cylindrical member 10, respectively. The construction is the same as that in the fourth example except for the above-mentioned matters.

In the metal halide lamp of D.C. lighting type in the vertical lighting, the convection of the filler gas in the vicinity of the arc peripheral portion 5 is parallel to the inner wall of the cylindrical member 10, as in the fourth example. Thus, the entire arc peripheral portion 5 is uniformly influenced by the convection. Therefore, the arc shape changes from a teardrop shape to a fusiform, as compared with the arc shape in the conventional lamp without the cylindrical member 10. The parallel convection of the filler gas in the vicinity of the arc peripheral portion 5 suppresses the arc expansion. As the result of the above, the uniformity of emission spectrum for various portions of the arc can be far improved.

Moreover, in the metal halide lamp of D.C. lighting type, the thermoelectrons are emitted from the cathode 14. Therefore, the start and the restart ability of the lamp can be improved by reserving at least the temperature of the cathode 14 by means of the cylindrical member 10 as described in the first example. In general, the anode 13 which is higher in temperature and is more likely to wear than the cathode 14 will not be further damaged. In other words, the cylindrical member 10 may be provided so as not to cover the anode 13. Alternatively, as is shown in FIG. 6, if the cylindrical member 10 is provided in such a manner that the lengths d5 and d6 satisfy a condition of d5<d6, the start and the restart abilities of discharge can be improved without causing an extra wear of the anode 13. It is appreciated that even if the lengths d5 and d6 have a relationship of d5≧d6, the effect of uniform light emission can be obtained.

In this example, a metal halide lamp of D.C. lighting type in the vertical lighting is described. However, for a metal halide lamp of D.C. lighting type in a horizontal lighting, the same effects can be obtained as to the improvements in the uniformity of emission spectrum for various portions of the arc, and in the start and the restart abilities of a lamp. In the horizontal lighting, as described in the third example, the arc curving degree is suppressed, so that the thermal stress on the upper portion of the arc tube 1 is reduced. As a result, the lamp lifetime can be extended.

It is apparent from the first and second examples that in the case of the metal halide lamp of D.C. lighting type in the horizontal lighting, it is sufficient to use a member which covers at least one of the upper and the lower portions of the electrode axis, instead of the cylindrical member 10. In this case, the relationship between the lengths d5 and d6 is the same as that in the above-mentioned case.

In the third through fifth examples, the cylindrical member 10 is formed of insulating and light transmitting alumina ceramics. The cylindrical member 10 may alternatively be formed of a light transmitting insulator having light diffusibility, such as polycrystalline alumina ceramics. If the cylindrical member 10 is formed of the light transmitting insulator, light beams emitted from various portions of the arc are mixed in the cylindrical member 10 when they pass through the cylindrical member 10. As a result, the uniformity of spectrum for various portions of the arc can be far improved at the emitting face of the cylindrical member 10.

Figure 7:
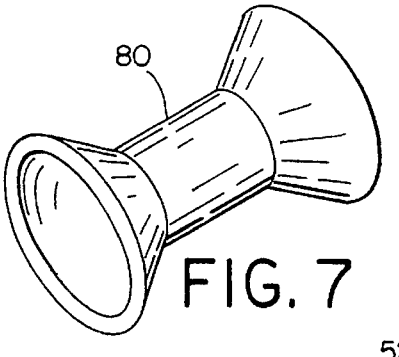
FIG. 7 is a perspective view showing another example of a cylindrical member in examples of the invention.

In the third through fifth examples, the cylindrical member 10 is circular in section along the electrode axis. The cylindrical member 10 may alternatively take another shape. For example, as is shown in FIG. 7, in an alternative cylindrical member 80, end portions each have a larger diameter than in the vicinity of the center portion thereof. Especially with such a shape of the cylindrical member 80, a distance from one end of an electrode to an inner face of the vicinity of one end portion of the cylindrical member 80 is made larger. Due to the increased distance, the grains of the electrode materials scattered from the electrode can easily diffuse, whereby the degree of blackening in the vicinity of the end portions of the cylindrical member 80 can additionally be reduced.

In the first to fifth examples, the convection regulating means is attached to the inner wall of the arc tube 1 with the supporting bar 7. However, the mounting position of the supporting bar 7 is not limited thereto. The member and number of the supporting bars 7 can be changed, and supporting and fixing methods other than those described in the examples can be used.

Figure 8B:
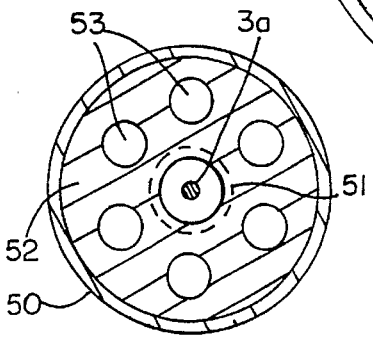
FIG. 8B is a cross-sectional view taken along a line 8B—8B in FIG. 8A.

Next, with reference to FIGS. 8A and 8B, a high pressure discharge lamp as a sixth example of the invention will be described.

Figure 8A:
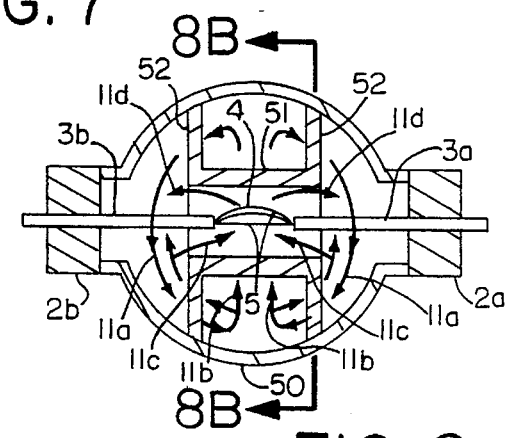
FIG. 8A is a cross-sectional view showing a metal halide lamp in a sixth example according to the invention.

FIG. 8A is a cross-sectional view showing a lamp in a horizontal lighting. In the lamp, a cylindrical member 51 as the convection regulating means is provided in an arc tube of light transmitting alumina ceramics. FIG. 8B is a cross-sectional view taken along a line 8B—8B in FIG. 8A.

The lamp includes an arc tube 50 of light transmitting alumina ceramics which is filled with metal halide, mercury and rare gas, and the cylindrical member 51 of light transmitting alumina ceramics. At each of both ends of the cylindrical member 51, a flange 52 having openings 53 is provided as a supporting bar for the cylindrical member 51. The construction of the lamp is the same as that in the third example except for the above matters.

Note that the thermal conductivity of alumina ceramics is about 0.08 (cal/cm·sec.·°C.), and the thermal conductivity of quartz is about 0.0035 (cal/cm·sec.·°C.). Since the thermal conductivity of alumina ceramics is higher than that of quartz, the temperature of the arc tube 50 of alumina ceramics is higher than that of the arc tube of quartz. Moreover, the arc tube 50 of alumina ceramics has a more uniform temperature distribution than the arc tube made of quartz. Therefore, the emitting region in the arc tube 50 is wide and the spectrum for various portions of the arc is more nonuniform as compared with the arc tube of quartz.

In this example, arc is formed in the cylindrical member 51, so that the convection of the filler gas is regulated in the same manner as described in the third example. As a result, the arc expansion is suppressed, so that the emitting region is narrowed. Thus, the uniformity of emission spectrum for various portions of the arc is far improved as compared with a metal halide lamp having a conventional arc tube of ceramics.

At the same time as the suppression of the arc expansion, the curving degree of the arc is reduced in the horizontal lighting. Therefore, the temperature of an upper portion of the arc tube 50 lowers and hence the thermal stress on the upper portion of the arc tube 50 is reduced. Accordingly, the lamp lifetime is also improved.

In the case where one of the electrodes 3*a* and 3*b* is covered with the cylindrical member 51, the start and the restart abilities of discharge can be improved, as described in the third example.

In this example, the cylindrical member 51 is fixed in the arc tube 50 with the flanges 52. The flange 52 is provided with a plurality of openings 53. Due to the openings 53, the flanges 52 cannot affect the convections indicated by the curves 11*a*, 11*b*, 11*c* and 11*d*. The shape and number of the openings 53, the cross-sectional shape of the cylindrical member 51, and the supporting and fixing methods of the cylindrical member 51 to the inner wall of the arc tube 50 are not limited to those described in this example.

In this example, a metal halide lamp having the arc tube 50 of light transmitting alumina ceramics is described. It is appreciated that another high pressure discharge lamp having an arc tube of other ceramic materials can attain the same effects.

In the horizontal lighting as is described in this example, it is apparent from the first and second examples that it is sufficient to use a member which covers at least one of the upper and the lower portions of the electrode axis, instead of the cylindrical member 51, for the purpose of the improvements in the uniformity of spectrum for various portions of the arc and in the start and the restart abilities.

In this example, a horizontal lighting lamp is described. Alternatively, a vertical lighting lamp can attain the same effects.

Next, a high pressure discharge lamp as a seventh example of the invention is described with reference to FIG. 9.

Figure 9:
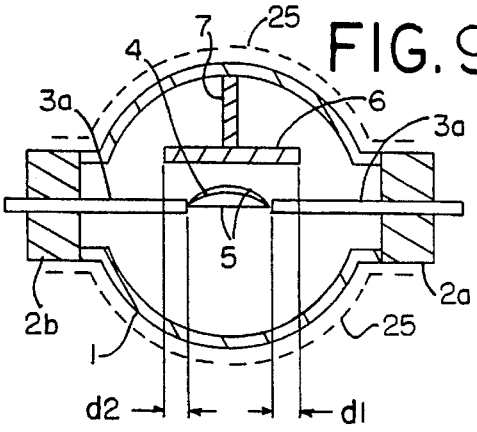
FIG. 9 is a cross-sectional view showing a metal halide lamp in a seventh example according to the invention.

FIG. 9 is a cross-sectional view showing the metal halide lamp of this example in which a structure covering an upper portion of the electrode axis is provided in an arc tube 1. In the metal halide lamp, a light transmitting and infrared reflecting film 25 is applied to an outer wall of the arc tube of the metal halide lamp. The construction of the lamp is the same as that in the first example except for the light transmitting and infrared reflecting film 25.

When the member 6 is introduced, the infrared radiation from the arc is slightly intercepted by the member 6, so that the lowest temperature in the arc tube 1 is further lowered. Therefore, vapor pressures of metal halide and mercury with which the arc tube 1 is filled are reduced during the lighting. As a result, the spectrum distribution and the luminance of light emission are varied, and the emission efficiency is lowered. However, if the light transmitting and infrared reflecting film 25 is applied to the outer wall of the arc tube 1, the inside temperature of the arc tube 1 rises as compared with the case without applying the light transmitting and infrared reflecting film 25. Due to the rise in temperature, the reduction in the lowest temperature by the provision of the member 6 can be avoided. Thus, the above problem can be overcome.

The provision of the light transmitting and infrared reflecting film 25 are effective for any location and shape of the member 6, and any supporting method, and for both of the horizontal and vertical lighting types.

The following examples are directed to improvements in the location of a member in an arc tube.

Figure 10A:
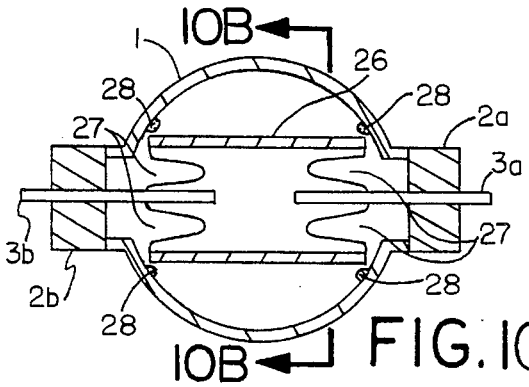
FIG. 10A is a cross-sectional view showing a metal halide lamp in an eight example according to the invention.
Figure 10B:
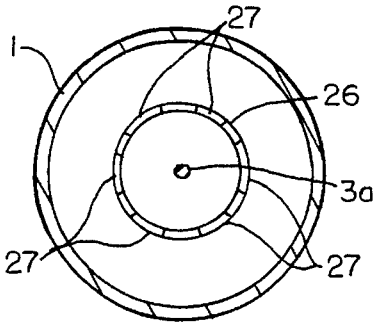
FIG. 10B is a cross-sectional view taken along a line 10B—10B in FIG. 10A.

An eighth example of the invention is described with reference to FIGS. 10A and 10B. FIG. 10A is a cross-sectional view showing a lamp of the lamp of the eighth example. In an arc tube 1, a cylindrical member 26 is provided. FIG. 10B is a cross-sectional view of the arc tube 1 taken along a line 10B—10B in FIG. 10A.

The cylindrical member 26 is made of alumina ceramics. In the side wall of the cylindrical member 26, openings 27 which extends in an axial direction are provided. Stopping members 28 are provided on an inner wall of the arc tube 1. The construction of the lamp is the same as that in the first example except for the above matters.

The cylindrical member 26 of alumina ceramics is supported at the inner wall of the arc tube 1 of quartz. That is, the cylindrical member 26 is located in the inside of the arc tube 1, as is shown in FIG. 10A. At the contacting portions of both end portions of the cylindrical member 26 with the inner wall of the arc tube 1, gaps are provided.

In the stable lighting, the arc tube and the member provided therein are expanded by the discharge arc at a high temperature. However, if the arc tube and the member are made of different materials which have different coefficients of expansion from each other, an extraordinary thermal stress may occur at the contacting portions or the junctions, which may result in cracks.

However, even when the arc tube 1 and the cylindrical member 26 are made of different materials which have different coefficients of expansion from each other, the gaps provided at the contacting portions of the cylindrical member 26 with the arc tube 1 absorb the extraordinary thermal stress caused by the different coefficients of thermal expansion. Therefore, the above dangerous problem in that cracks occur in the arc tube 1 and the cylindrical member 26 and damage them in the lighting can be avoided.

In the case where the gaps are narrow and thus the flow rate of the filler gas into the cylindrical member 26 is reduced, the openings 27 are provided in order to facilitate the filler gas to flow into the cylindrical member 26. Therefore, the provision of the gaps do not affect the discharge and emission conditions.

The stopping members 28 are provided for suppressing the movement of the cylindrical member 26 in a direction perpendicular to the electrode axis direction. If the cylindrical member 26 can be tightly fixed to the inner wall of the arc tube 1 so that the cylindrical member 26 is positioned in the arc tube 1, the stopping members 28 can be omitted.

Next, with reference to FIGS. 11A and 11B, a ninth example of the invention will be described.

Figure 11A:
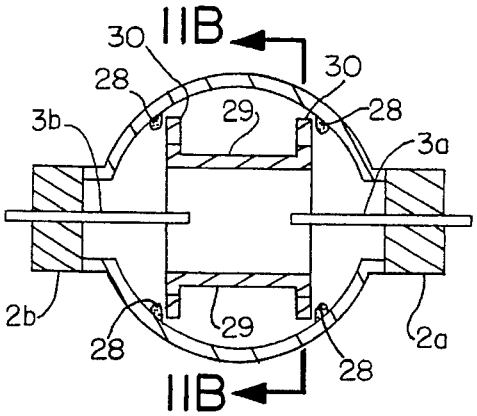
FIG. 11A is a cross-sectional view showing a metal halide lamp in a ninth example according to the invention.

FIG. 11A is a cross-sectional view showing a lamp of this example. In FIG. 11A, a cylindrical member 29 is located in an arc tube 1 and covers the electrode axis. The cylindrical member 29 is provided with two flanges 30 made of the same material on its outer face. FIG. 11B is a cross-sectional view taken along a line 11B—11B in FIG. 11A.

The lamp of this example includes the cylindrical member 29. On the outer face at both ends of the cylindrical member 29, two flanges 30 of alumina ceramics are provided. The construction of the lamp of this example is the same as that in the eighth example except for the above matters.

The cylindrical member 29 is supported on an inner wall of the arc tube 1 of quartz by means of the two flanges 30. At the contacting portion of the circumferential portion of each of the flanges 30 with the inner wall of the arc tube 1, a slight gap is provided. Even when the arc tube 1 and the cylindrical member 29 (the flanges 30) are made of different materials with different coefficients of thermal expansion from each other, an extraordinary thermal stress caused by the different coefficients of thermal expansion can be absorbed by the gaps. As a result, a problem in that cracks occur in the arc tube and the member in the lighting can be avoided.

If the gaps are very narrow and thus the convection of the filler gas in the electrode axis direction is largely intercepted by the flanges 30, the flanges 30 are provided with cutout portions 31. As a result, the influence of the flanges 30 on the convection can be reduced. Thus, the presence of the flanges 30 do not affect the discharge and emission conditions.

The stopping members 28 are provided for suppressing the movement of the cylindrical member 29 in the electrode axis direction via the flanges 30. If the cylindrical member 29 can be tightly fixed to the inner wall of the arc tube 1 by means of the flanges 30 so that the cylindrical member 29 is positioned in the arc tube 1, the stopping members 28 can be omitted.

Figure 11B:
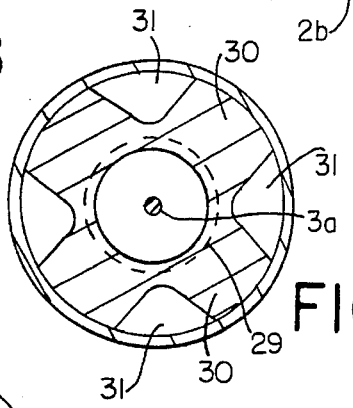
FIG. 11B is a cross-sectional view taken along a line 11B—11B in FIG. 11A.
Figure 11C:
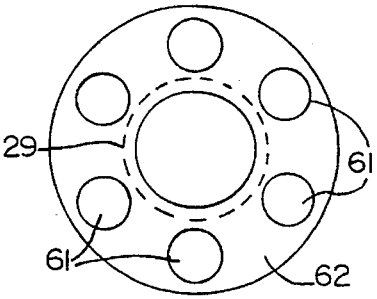
FIG. 11C shows another type of flange in the ninth example of the invention.

The numbers of the flanges 30 and the formed portions thereof on the outer face of the cylindrical member 29 cannot be limited to those described by referring to FIGS. 11A and 11B. Also, the shape of the flange 30 is not limited to that shown in this example. For example, as is shown in FIG. 11C which is taken in the same way as FIG. 11B, a flange 62 having openings 61 may be used.

Figure 12A:
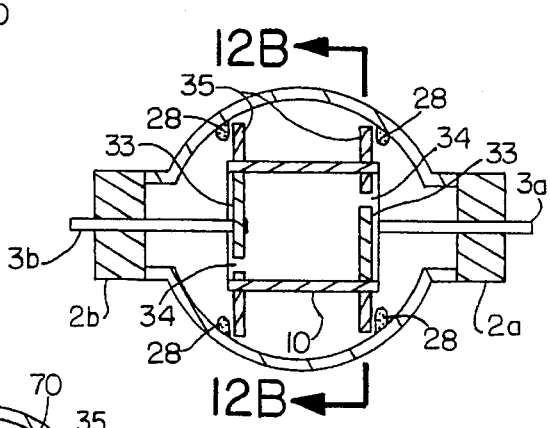
FIG. 12A is a cross-sectional view showing a metal halide lamp in a tenth example according to the invention.
Figure 12B:
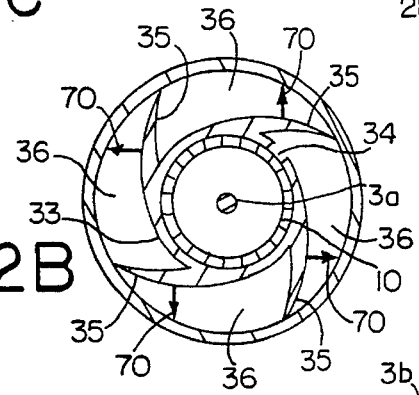
FIG. 12B is a cross-sectional view taken along a line 12B—12B in FIG. 12A.
Figure 13:
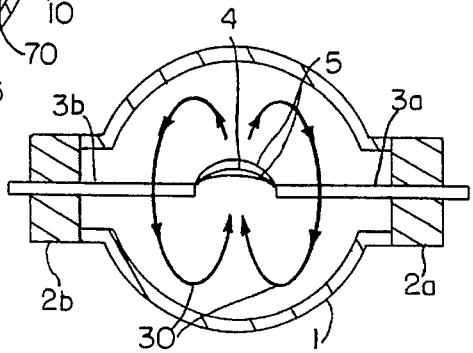
FIG. 13 PRIOR ART
FIG. 13 is a cross-sectional view showing a metal halide lamp in a conventional example.

Next, with reference to FIGS. 12A and 12B, a tenth example of the invention will be described. FIG. 12A is a cross-sectional view showing a lamp of the tenth example. In FIG. 12A, a cylindrical member 10 having two supporting members with protrusions which are radially provided are positioned in an arc tube. FIG. 12A is a cross-sectional view taken along a line 12B—12B in FIG. 12B.

The lamp of this example includes the cylindrical member 10 of alumina ceramics. Two rings 33 are attached on an outer face at both ends of the cylindrical member 10. Each of the rings 33 has four protrusions 35 and a cut portion 34. The ring 33 is made of alumina ceramics with elasticity. The construction of the lamp of this example is the same as in the eighth example except for the above matters.

The ring 33 is in contact with the inner wall of the arc tube 1 via the elastic protrusions 35. Therefore, the stress caused by the expansion of the ring 33 is absorbed by the protrusions 35 in such a manner that they bend in a direction indicated by an arrow 70 in FIG. 12B. Accordingly, if the cylindrical member 10 expands due to the discharge arc at a high temperature in the stable lighting, the extraordinary stress cannot act on the arc tube 1. Since the ring 33 has the cut portion 34 so as to accommodate the expansion of the ring 33, the ring 33 cannot be broken by the expansion of the cylindrical member 10. The convection of the filler gas along the electrode axis direction occurs via openings 36 between the respective protrusions 35, so that the presence of the rings 33 do not affect the discharge and emission conditions.

As the result of the above, even if the arc tube 1 and the cylindrical member 10 are made of different materials with different coefficients of thermal expansion from each other, the problem in that cracks occur in the arc tube 1 and the cylindrical member 10 and damage them can be avoided. It is apparent from the eighth or ninth example that, if a slight gap is provided at a contact portion of the protrusions 35 of the ring 33 with the inner wall of the arc tube 1, the stress acting on the arc tube 1 can be further reduced.

The stopping members 28 are provided for suppressing the movement of the cylindrical member 10 in the electrode axis direction. If the cylindrical member 10 can be tightly fixed to the inner wall of the arc tube 1 by means of the rings 33 so that the cylindrical member 10 is positioned in the arc tube 1, the stopping members 28 can be omitted.

The numbers of the rings 33 and the formed portions thereof on the outer face of the cylindrical member 10, and the number and shape of the protrusions 35 are not limited to those described in this example. The ring 33 can be made of a material other than alumina ceramics used in this example, as far as the material is elastic and has light transmitting property.

In the eighth to tenth examples, a metal halide lamp of horizontal lighting type is described. However, it is appreciated that a metal halide lamp of vertical lighting type can attain the same effects.

The present invention is described regarding a metal halide lamp as an example. However, the invention can attain the same effects for other high pressure discharge lamps such as a high pressure mercury lamp, a high pressure sodium lamp, and a high pressure xenon lamp. Although preferred examples of the invention have been described, the descriptions are not limitations and it is appreciated that the present invention can have various modifications.

As described above, according to the invention, an insulating and light transmitting member or an insulating and light transmitting member having light diffusibility is provided as the convection regulating means in an arc tube of a high pressure discharge lamp. By the use of the member, the curve of the arc due to the convection of the filler gas, the deformation of the arc to a teardrop shape, or the expansion of the arc can be prevented. Moreover, the uniformity of emission spectrum for various portions of arc can be improved. As a result, an optical system which is used in conjunction with the lamp is easily designed, and the lamp lifetime can be extended by the prevention of the curve of the arc.

Furthermore, the member reserves the temperature of the electrodes, so that thermoelectrons are easily emitted from the electrodes. Thus, the amount of energy required for starting and restarting the lamp can be reduced. Therefore, the lighting circuit can be miniaturized.

In addition, the degree of heat reserving effect of the member can be controlled by the degree to which the electrode is covered with the member, so that the reduction in the lifetime of an upper electrode in vertical lighting or an anode in horizontal lighting which is more likely to wear can be prevented.

By providing a cylindrical member in an arc tube in such a manner that a slight gap is provided between the cylindrical member and an inner wall of the arc tube, or by providing a cylindrical member via insulating and light transmitting support means with elasticity, even when the arc tube and the cylindrical member are made of different materials with different coefficients of thermal expansion from each other, an extraordinary thermal stress caused by the different coefficients of thermal expansion can be absorbed by the gap or the elastic support means. Accordingly, the problem in that cracks occurs in the arc tube and the member and damage them in the lighting can be avoided. Therefore, the arc tube and the cylindrical member can be formed of different materials, which allows a highly practicable arc tube to be designed.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A high pressure discharge lamp comprising:

a discharge tube which is filled with gas;

a first electrode having a first end, said first electrode being provided in said discharge tube; and a second electrode having a second end which is positioned away from said first end by a certain distance, said second electrode being provided in said discharge tube, wherein arc discharge is induced by a voltage applied between said first end of said first electrode and said second end of said second electrode, said high pressure discharge lamp further comprising convection regulating means which is electrically insulating and provided in said discharge tube, said convection regulating means suppressing the deformation of said arc discharge caused by the convection of said gas in said discharge tube, and wherein a virtual straight line connecting said first end of said first electrode to said second end of said second electrode is set substantially horizontal such that during normal operation said lamp is in an overall substantially horizontal position, and wherein said convection regulating means is provided on at least one of upper and lower sides of said straight line.

2. A high pressure discharge lamp according to claim 1, wherein said convection regulating means is fixed to said discharge tube by supporting means.

3. A high pressure discharge lamp according to claim 1, wherein said convection regulating means takes a curved shape around said virtual straight line.

4. A high pressure discharge lamp according to claim 1, wherein said convection regulating means takes a plate-like shape.

5. A high pressure discharge lamp according to claim 1, wherein said convection regulating means is a light transmitting sleeve member having a bore around said virtual straight line, said arc discharge being induced in said bore.

6. A high pressure discharge lamp according to claim 5, wherein said bore of said convection regulating means includes at least one of said first and second ends.

7. A high pressure discharge lamp according to claim 5, wherein said lamp is a direct current type high pressure discharge lamp in which said first electrode functions as an anode, and said second electrode functions as a cathode, and wherein a portion of said second electrode as said cathode which includes at least said second end is located in said bore.

8. A high pressure discharge lamp according to claim 7, wherein a portion of said first electrode which includes at least said first end is also located in said bore, and wherein a length d5 of said portion of said first electrode is smaller than a length d6 of said portion of said second electrode (d5<d6).

9. A high pressure discharge according to claim 1, wherein said convection regulating means is directly supported by an inner wall of said discharge tube, and wherein a gap is provided between said convection regulating means and said inner wall of said discharge tube, in order to suppress the stress caused by a difference between a coefficient of thermal expansion of said convection regulating means and a coefficient of thermal expansion of said inner wall of said discharge tube.

10. A high pressure discharge lamp according to claim 1, wherein said convection regulating means includes two or more flanges made of the same material as that of said convection regulating means, said convection regulating means being supported by said inner wall of said discharge tube via said flanges, and wherein a gap is provided between said flanges and said inner wall of said discharge tube, in order to suppress the stress caused by a difference between a coefficient of thermal expansion of said convection regulating means and a coefficient of thermal expansion of said inner wall of said discharge tube.

11. A high pressure discharge lamp according to claim 1, wherein said convection regulating means includes two or more O-shaped rings having a plurality of radial protrusions, said convection regulating means being supported by an inner wall of said discharge tube via said O-shaped rings, and wherein a gap is provided between said O-shaped rings and said inner wall of said discharge tube, in order to suppress the stress caused by a difference between a coefficient of thermal expansion of said convection regulating means and a coefficient of thermal expansion of said inner wall of said discharge tube.

12. A high pressure discharge lamp according to claim 1, said lamp further comprising a light transmitting and infrared reflecting film provided outside of said discharge tube.

13. A high pressure discharge lamp according to claim 1, wherein said convection regulating means includes an insulating portion with light diffusibility.

14. A high pressure discharge lamp according to claim 5, wherein at least one of end portions of said bore of said sleeve member has a larger diameter than that of a center portion of said bore.

15. A high pressure discharge lamp according to claim 5, wherein said sleeve member is located in said discharge tube with gaps between at least parts of circumferential end portions of said sleeve member and an inner wall of said discharge tube.

16. A high pressure discharge lamp according to claim 5, wherein said sleeve member is located in said discharge tube via supporting means, said supporting means being a light transmitting insulator with elasticity.

17. A high pressure discharge lamp according to claim 1, wherein said discharge tube is made of ceramics.

* * * * *